US007953334B2

(12) United States Patent
Shida

(10) Patent No.: US 7,953,334 B2
(45) Date of Patent: May 31, 2011

(54) IMAGE FORMING APPARATUS FOR MEASURING THE AMOUNT OR DENSITY OF TONER OF A TONER PATCH

(75) Inventor: Tomonori Shida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 614 days.

(21) Appl. No.: 11/461,341

(22) Filed: Jul. 31, 2006

(65) Prior Publication Data

US 2007/0036568 A1 Feb. 15, 2007

(30) Foreign Application Priority Data

Aug. 4, 2005 (JP) ..... 2005-226521

(51) Int. Cl.
*G03G 15/00* (2006.01)

(52) U.S. Cl. ..... 399/49

(58) Field of Classification Search ..... 399/49, 399/58–60, 72

See application file for complete search history.

(56) References Cited

U.S. PATENT DOCUMENTS 5,150,155 A * 9/1992 Rushing ..... 399/39
6,185,386 B1 * 2/2001 Noguchi ..... 399/49

* cited by examiner

*Primary Examiner* — David M Gray
*Assistant Examiner* — Ruth N Labombard
(74) *Attorney, Agent, or Firm* — Canon U.S.A., Inc. I.P. Division

(57) ABSTRACT

An image-forming apparatus includes an optical sensor including a light-receiving element that receives light reflected by a belt-like moving medium to produce an output corresponding to the amount of light received. This image-forming apparatus determines the density of a toner patch image formed by an image-forming unit by correcting an output produced when the optical sensor detects the toner patch image at a position on a roller disposed opposite the sensor on the basis of an output produced by the optical sensor in an area where no toner image is formed on the belt-like moving medium at the same position on the opposite roller as the position where the sensor detects the toner patch image.

6 Claims, 9 Drawing Sheets

IMAGE FORMING APPARATUS FOR MEASURING THE AMOUNT OR DENSITY OF TONER OF A TONER PATCH

BACKGROUND OF THE INVENTION

1. Field of the Invention

The present invention relates to image-forming apparatuses and methods for measuring the amount or density of toner of a toner patch formed on a belt-like moving medium suspended on rollers.

2. Description of the Related Art

Known image-forming apparatuses are divided into various types, including electrophotographic apparatuses, heat-transfer apparatuses, and inkjet apparatuses. Among them, electrophotographic apparatuses are superior to other types of image-forming apparatuses in terms of high speed, high image quality, and quiet operation, and thus have increasingly become widespread in recent years. Electrophotographic apparatuses are further divided into various types, including multiple transfer apparatuses and apparatuses having an intermediate transfer member, which are well known types. Other types include multiple development apparatuses, which form color images on a photosensitive member and simultaneously transfer the images to create a single image, and in-line apparatuses, which have image-forming units (process stations) of different colors arranged in line to transfer developed images to a transfer material fed by a transfer belt. Among them, in-line apparatuses are advantageous in terms of high speed, high image quality, and a small number of times of image transfer.

FIG. 3 illustrates the structure of an in-line image-forming apparatus. In FIG. 3, an electrostatic-attraction feed belt (hereinafter referred to as an ETB) 1 is suspended on a drive roller 6, a roller 7 disposed opposite an attraction roller 5, and tension rollers 8 and 9. The ETB 1 rotates in a direction indicated by the arrow. Process stations 201 (yellow), 202 (magenta), 203 (cyan), and 204 (black) are arranged in line along the circumferential surface of the ETB 1, each including a photosensitive member disposed in contact with one of transfer rollers 3 with the ETB 1 disposed therebetween. The attraction roller 5 is disposed in contact with the roller 7 upstream of the process stations 201, 202, 203, and 204. A transfer material P is biased when passing through a nip between the attraction roller 5 and the roller 7. A power supply 16 charges the ETB 1 through the roller 5. The transfer material P is electrostatically attracted to the ETB 1 and is fed in the direction indicated by the arrow.

An example of the ETB 1 used in the known art is a resin film having a thickness of about 50 to 200 μm and a volume resistivity of about $10^9$ to $10^{16}$ Ωcm and formed of, for example, polyvinylidene fluoride (PVdF), an ethylene-tetrafluoroethylene copolymer (ETFE), a polyimide, polyethylene terephthalate (PET), or a polycarbonate. Another example is a resin film including, for example, a base layer having a thickness of about 0.5 to 2 mm and formed of a rubber, such as an ethylene-propylene-diene monomer (EPDM), and a surface layer formed by dispersing a fluoropolymer, such as polytetrafluoroethylene (PTFE), in a urethane rubber. Such resin films may have, for example, an acrylic coating to increase glossiness.

The image-forming process of the in-line image-forming apparatus will now be described. First, the image-forming process of the process stations 201, 202, 203, and 204 is described below. The description focuses on the image-forming process of the yellow process station 201, although the other process stations 202, 203, and 204 have similar image-forming processes.

FIG. 4 illustrates the structure of the process station 201. A charging unit 212 uniformly charges a photosensitive member 211. An optical exposure system 213 scans the photosensitive member 211 with light 214 to form a latent image thereon. A developing roller 215 develops the latent image to form a toner image on the photosensitive member 211 by depositing toner stored in a toner container 216. Residual toner left after a transfer process described below is scraped off by a cleaning blade 217 and is recovered into a waste toner container 218.

Next, the transfer process is described below.

In reversal development, a commonly used development process, a negatively charged toner, for example, is used for development of exposed areas on a negatively charged organic photoconductor (OPC). Hence, bias power supplies 4 apply a positive transfer bias to the transfer rollers 3. The transfer rollers 3 used are typically low-resistance rollers.

In actual printing, the image-forming process, the transfer process, and the feeding of the transfer material P are performed at such timings that toner images of the individual colors are aligned on the transfer material P. These processes are controlled according to the moving speed of the ETB 1 and the distances between the transfer positions of the process stations 201, 202, 203, and 204. A single toner image is created on the transfer material P each time the transfer material P passes through the process stations 201, 202, 203, and 204. After the creation of the toner image, the transfer material P is allowed to pass through a known fusing unit which in turn fuses the toner image on the transfer material P.

Image density varies with the temperature/humidity conditions under which the image-forming apparatus is used and the frequency with which the process stations 201, 202, 203, and 204 are used. Such density variations are corrected by image density control described below. FIG. 13 is a block diagram of a control system of the image-forming apparatus.

In FIG. 13, an image-forming apparatus 30 includes a controller 31 and an engine 32 including a control unit 33. A host computer 20 or the controller 31 directs the image-forming apparatus 30 to form toner patch images of the individual colors for density control on a photosensitive member, an intermediate transfer belt (hereinafter referred to as an ITB), or an ETB. A density sensor 13 detects the toner patches. The control unit 33 includes a memory 35 for storing the detection results and a CPU 34 for calculating the densities of the toner patches. The control unit 33 feeds back the calculation results to process conditions, such as high-voltage conditions 37 for charging and development and the power of a laser 36, to adjust the maximum density for each color and cancel out γ characteristics (nonlinear input/output characteristics specific to electrophotography) for each color, thus controlling halftone characteristics. In general, the density sensor 13 illuminates the toner patches with light from a light source and detects the intensity of reflected light with a light-receiving element. The intensity signals of the reflected light are subjected to A/D conversion, are processed by the CPU 34, and are fed back to the process conditions.

The image density control is intended to maintain a constant maximum density for each color (hereinafter referred to as Dmax control) and to maintain halftone characteristics linear with respect to image signals (hereinafter referred to as Dhalf control). The Dhalf control also has great significance in maintaining a constant color balance and preventing spatters from toner characters of overlapping colors and defective fusion due to excessive amounts of toner deposited.

In the Dmax control, generally, image-forming conditions are controlled by detecting toner patches formed under different image-forming conditions using an optical sensor and determining such conditions that the desired maximum density can be achieved according to the detection results. Halftone toner patches are often formed in the Dmax control. The detection of solid images causes difficulty in providing sufficient detection accuracy because of the narrow range of variations in sensor output relative to variations in the amount of toner. The Dmax control based on the detection of toner patches is not required for systems in which the maximum density for each color depends more largely on the thickness of an OPC and image-forming environments than on image-forming conditions. Such systems are advantageous in terms of usability and toner consumption because the image-forming conditions of the systems can be determined according to environment detection results and CRG tag information.

The Dhalf control cancels out γ characteristics to prevent formation of unnatural images due to deviations of output densities from input image signals and thus enable image processing with linear input/output characteristics. In the Dhalf control, toner patches corresponding to different input image signals are detected using an optical sensor to determine the relationship between input image signals and densities. The controller 31 then converts image signals input from the host computer 20 on the basis of the signal-density relationship to determine the density desired for the input image signals. The Dhalf control is generally performed after the image-forming conditions are determined by the Dmax control.

The toner patches formed on the ETB 1 are electrostatically recovered into the process stations 201, 202, 203, and 204 by a cleaning process. The toner of the toner patches, as well as the toner left after the transfer process, is attracted to the photosensitive members 211 by applying a reverse bias thereto and is scraped off by the cleaning blades 217. The method used for cleaning the ETB 1 is not limited to the electrostatic recovery described above and can also be performed by physical recovery, for example, by bringing a cleaning blade into contact with the ETB 1.

If a density sensor is disposed opposite one of rollers supporting a belt-like rotating medium, foreign matter adhering to the opposite roller, for example, can produce an adverse effect on sensor output despite only small positional variations in glossiness existing on the belt-like rotating medium. This problem is particularly serious for detection of toner patches with lower densities. This problem remains the same for a system with large positional variations in glossiness on a belt-like rotating medium even if sensor outputs measured on toner patches are normalized with respect to those measured on the rotating medium to cancel out variations in the amount of reflected light due to the rotating medium. This problem can be avoided in the normalization method if the circumference of the rotating medium is equal to an integral multiple of that of the opposite roller.

In practice, however, such an integral multiple relationship is often difficult to select because the selection of the circumferences of the rotating medium and the opposite roller is restricted by, for example, the height of the image-forming apparatus. Variations in the amount of light reflected by the rotating medium can be correctly estimated by a modified averaging process if the variations form a sinusoidal curve due to variations in the outer diameter of the opposite roller.

In an example of the averaging process, the amounts of reflected light are detected on the rotating medium or toner patches at regular intervals over a range equivalent to the circumference of the opposite roller. The detection results may be averaged to cancel out misdetection due to the opposite roller. The amount of reflected light can then be correctly estimated by subtracting variations in the amount of reflected light due to the rotating medium. Variations in the amount of reflected light due to foreign matter adhering to the opposite roller, however, are difficult to cancel out by the averaging process because such variations form a periodic but asymmetrical wave.

SUMMARY OF THE INVENTION

In light of the above problems, the present invention provides an image-forming apparatus that can accurately measure the density of toner deposited on a belt-like moving medium, such as an ITB or an ETB, with a density sensor even if, for example, foreign matter adheres to a roller disposed opposite the sensor.

An image-forming apparatus according to the present invention includes a plurality of rollers, a belt-like moving medium suspended on the rollers, an image-forming unit that forms a toner image on the belt-like moving medium, an optical sensor that is disposed opposite one of the rollers and produces outputs, a storing unit that stores the outputs produced by the optical sensor in an area where no toner image is formed on the belt-like moving medium, and a determining unit that determines the density of a toner patch image formed by the image-forming unit by correcting an output produced when the optical sensor detects the toner patch image at a position on the roller disposed opposite the sensor on the basis of an output selected from the outputs stored in the storing unit. The selected output is produced at the same position on the roller disposed opposite the sensor as the position where the sensor detects the toner patch image.

The image-forming apparatus according to the present invention can measure the densities of toner patches more accurately by providing an non-toner area with a length that is larger than or equal to the circumference of the roller disposed opposite the optical sensor together with the toner patches and correcting the densities of the toner patches on the basis of sensor outputs produced in the non-toner area.

Further features of the present invention will become apparent from the following description of exemplary embodiments with reference to the attached drawings.

DESCRIPTION OF THE EMBODIMENTS

Embodiments

Exemplary embodiments of the present invention will now be described with reference to the attached drawings, although the invention is not limited to the embodiments described herein.

First Embodiment

Figure 3:
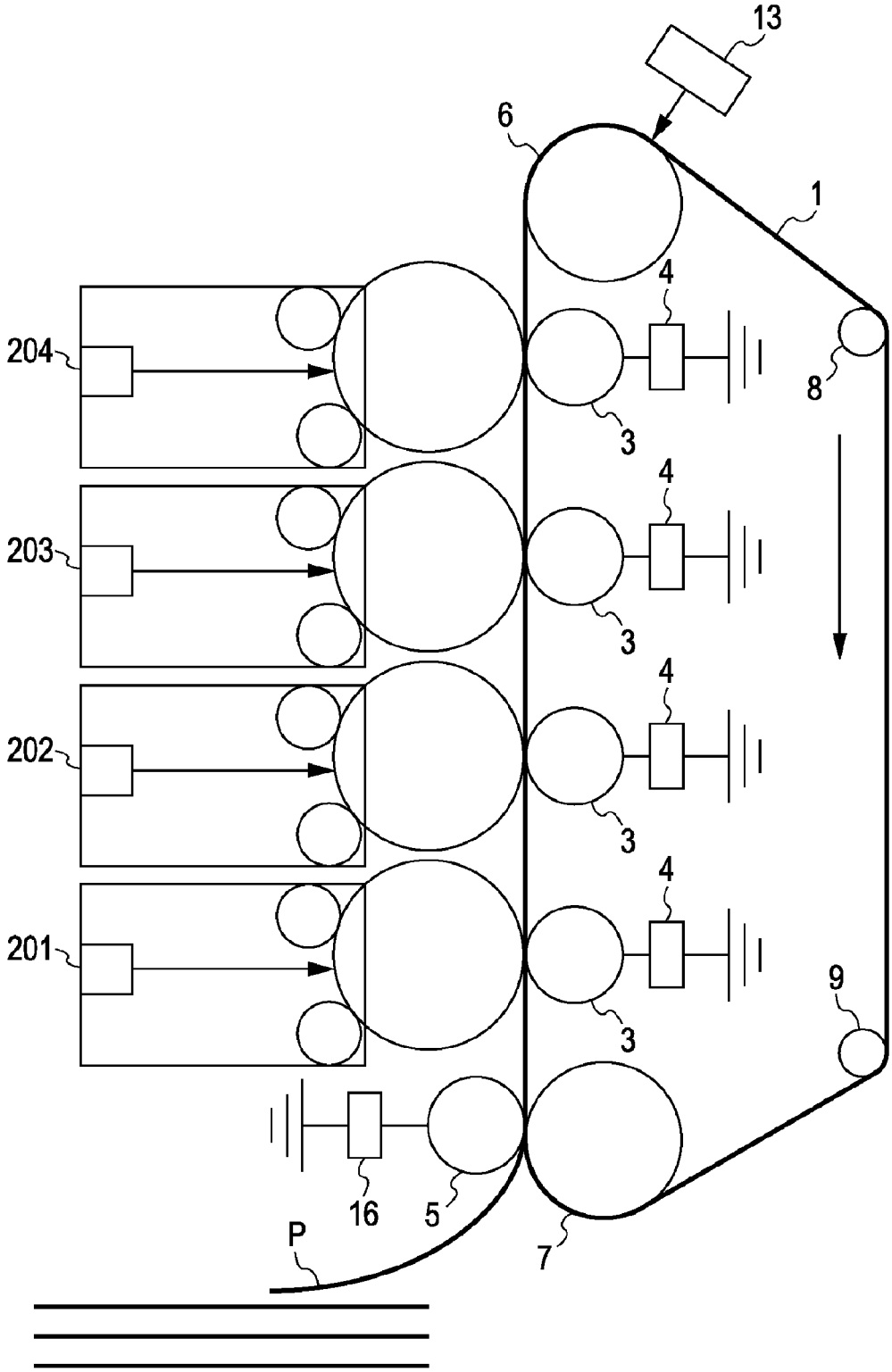
FIG. 3 is a schematic diagram of an image-forming apparatus according to the first embodiment of the present invention.
Figure 4:
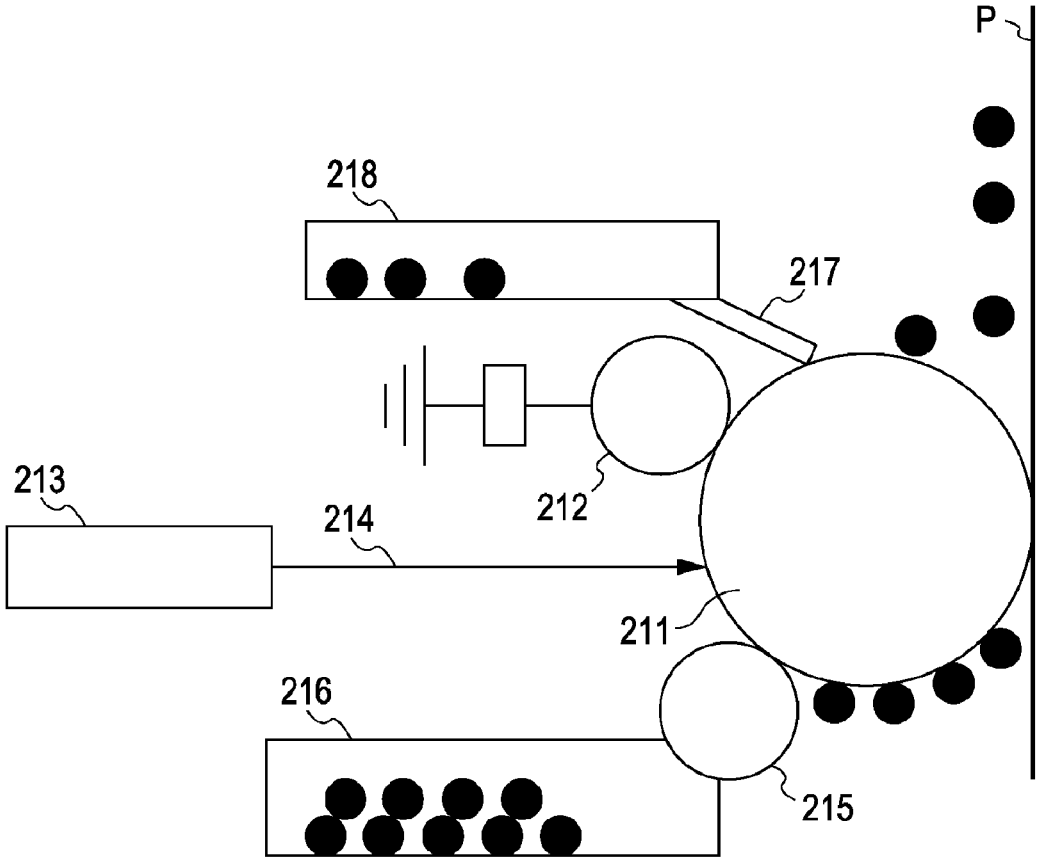
FIG. 4 is a schematic diagram of a process station.

A first embodiment of the present invention is described below with reference to FIG. 3. As described above, FIG. 3 is a schematic diagram of an image-forming apparatus.

An ETB 1 used in this embodiment is a resin belt including a PVdF film having a circumference of 700 mm and a thickness of 100 μm and an acrylic coating having a thickness of 1 μm. The structure of an optical sensor 13 is schematically illustrated in FIG. 5.

Figure 5:
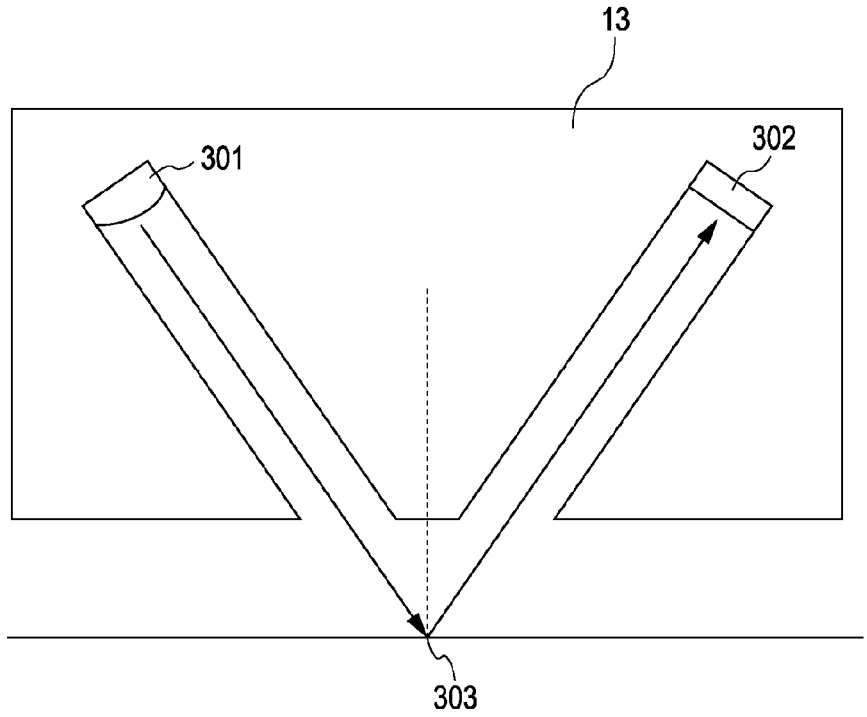
FIG. 5 is a schematic diagram of a density sensor.

In FIG. 5, the optical sensor 13 includes a light-emitting element 301, such as an LED, and a light-receiving element 302, such as a photodiode. Illumination light emitted from the light-emitting element 301 impinges on the ETB 1 at an angle of 30° with respect to the ETB 1 and is reflected at a detection position 303. The light-receiving element 302 is disposed at a position where it can detect light reflected at the same angle as the incident angle of the illumination light to detect specularly reflected light. The optical sensor 13 used in this embodiment produces a higher voltage as it detects reflected light with higher intensity.

The properties of reflected light detected when the optical sensor 13 illuminates a toner patch is described in detail below.

Figure 6:
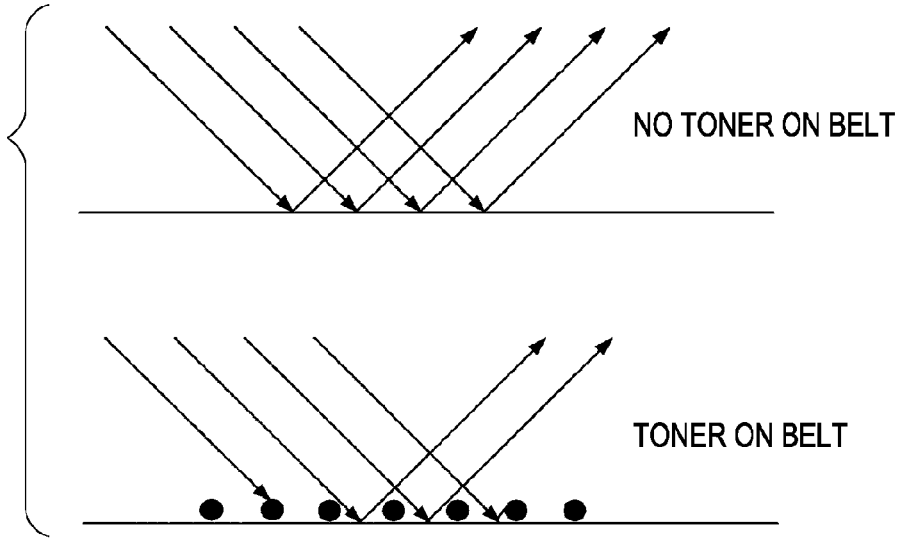
FIG. 6 includes schematic diagrams illustrating density measurement based on the detection of specularly reflected light.
Figure 7:
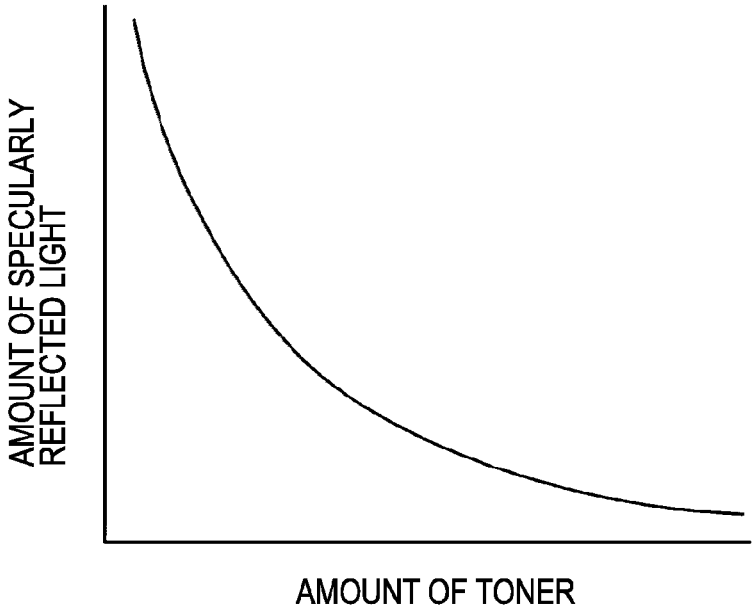
FIG. 7 is a graph showing the relationship between the amount of toner deposited on the belt-like moving medium and the amount of specularly reflected light.

As shown in FIG. 5, the light impinging on the ETB 1 is reflected according to a refractive index determined by the specific refractive index of the material for the ETB 1 and the surface conditions thereof before the reflected light is detected by the light-receiving element 302. If a toner patch is present at the detection position 303, the toner patch covers the ETB 1 at the detection position 303 and thus decreases the amount of reflected light (FIG. 6). FIG. 7 shows that the amount of reflected light decreases with increasing amount of toner of the toner patch. The density of the toner patch is therefore determined from the decrease in the amount of reflected light.

A density sensor designed to detect specularly reflected light may be used because this type of sensor can measure the amount of black toner on a black ETB. Typical ETBs often have a black or dark gray color because carbon black is dispersed therein for resistance adjustment. A light-receiving element for detecting the amount of diffused reflected light (not shown) may be provided to accurately detect highly chromatic colors.

In this embodiment, the density sensor 13 is disposed opposite a drive roller 6 having a circumference of 74 mm so that the drive roller 6 can support the ETB 1 from backside to stabilize the behavior thereof during rotation. Although the density sensor 13 is disposed opposite the drive roller 6 in this embodiment, the density sensor 13 may be disposed opposite any of rollers supporting the ETB 1, including a roller 7 disposed opposite an attraction roller 5 and tension rollers 8 and 9. In this embodiment, the density sensor 13 is disposed opposite the roller with the largest circumference, namely, the drive roller 6, because the sensor 13 requires higher positional accuracy in the rotational direction as the opposite roller has a smaller circumference.

The ETB 1, as described above, exhibits a stable behavior if the density sensor 13 is disposed opposite any of the rollers supporting the ETB 1. The output of the density sensor 13, however, is susceptible to the state of the opposite roller because the ETB 1 does not have a circumference equal to an integral multiple of that of the opposite roller in this embodiment. That is, foreign matter of unpredictable size can adhere to the opposite roller at unpredictable positions. In the known art, such foreign matter can make it difficult to accurately detect the density of a toner patch. Examples of such foreign matter include dust deposited during manufacturing and ETB shavings left after the use of the image-forming apparatus.

Unlike a substantially sinusoidal sensor output due to variations in the outer diameter of the opposite roller, a sensor output with variations due to foreign matter adhering to the opposite roller forms a periodic but asymmetrical wave (non-sinusoidal wave). Such variations are difficult to remove by an output-averaging process because this process is intended for symmetrical waves. In addition, the averaging process requires an enormous number of sampling points to grasp an output waveform because variations in the amount of reflected light due to the opposite roller vary for individual apparatuses and form a complicated waveform.

A Dhalf control in this embodiment which can cancel out the effect of foreign matter adhering to the opposite roller is described below. In the Dhalf control, the toner density measurement is performed in an area where no toner is deposited on a surface of the ETB 1 without determining and subtracting variations in the amount of reflected light due to the surface of the ETB 1 and the opposite roller, which contribute to misdetection. Hence, the toner density measurement involves misdetection due to, for example, foreign matter adhering to the opposite roller. The misdetection can be revealed from the calculation results of the toner density measurement. The toner densities of toner patches of the individual colors are finally determined by subtracting the misdetection due to the opposite roller from measurements of the toner densities of the toner patches. Ideally, the detection of the non-toner area should result in a toner density of zero; if a certain toner density is detected in the non-toner area, the toner density is fed back to the measurements of the densities of the toner patches as misdetection due to the opposite roller.

In this embodiment, toner deposited on the ETB 1 is electrostatically recovered as in the example of the known art, rather than using a cleaning member for physically scraping off the toner. Toner images formed on the ETB 1 therefore remain during the density control. The toner images remain similarly if a cleaning member that can be separated from the ETB 1 is used.

Figure 1:
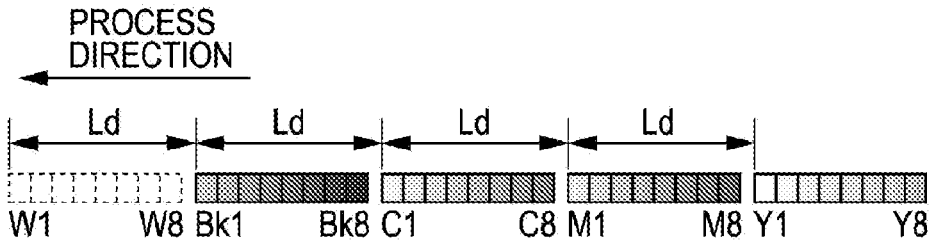
FIG. 1 is a diagram of an example of toner patches used in a first embodiment of the present invention.

In this embodiment, a non-toner area (white patch) with a length equivalent to the circumference of the drive roller 6 is provided together with the toner patches of the individual colors. In addition, each of the distances between the leading ends of the toner patches is equal to the circumference of the drive roller 6. Referring to FIG. 1, the distances Ld between the leading ends of the yellow and magenta toner patches, between the leading ends of the magenta and cyan toner patches, and between the leading ends of the cyan and black toner patches are each 74 mm in this embodiment. Toner density measurement using the non-toner area can determine the effect of misdetection due to, for example, foreign matter adhering to the drive roller 6 on measurements of the densities of the toner patches at different phases (positions) on the drive roller 6 to correct the measurements at the individual phases. The correction method described above can reduce the firmware memory region used because the correction can be performed only by detecting a specific area, namely, the non-toner area. This method is therefore advantageous in terms of cost.

Figure 14:
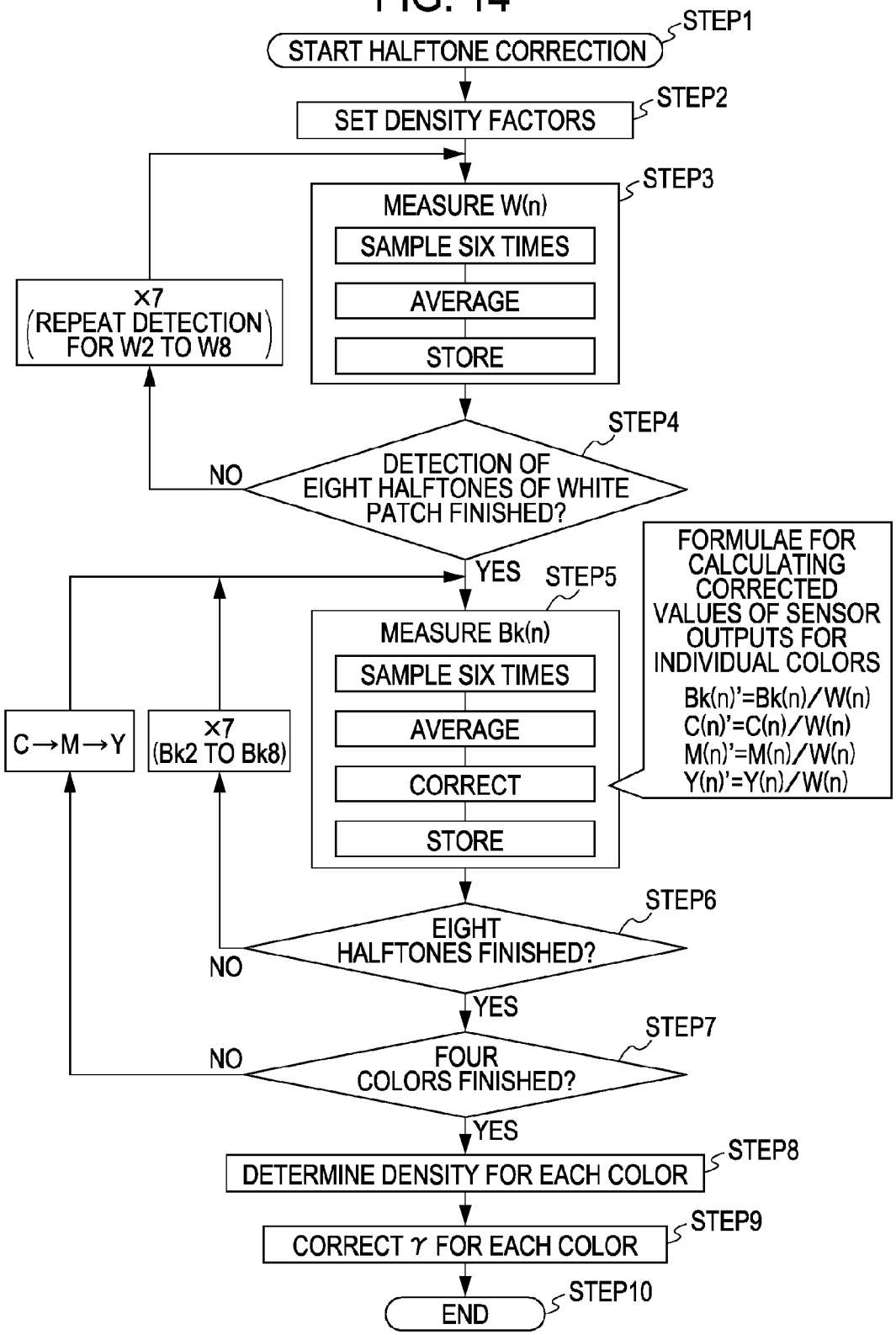
FIG. 14 is a flowchart of a density correction process in the present invention.

An exemplary correction process is described below. The control system of the image-forming apparatus in this embodiment is similar to that of the image-forming apparatus of the known art, and the description thereof is omitted. FIG. 14 is a flowchart of the correction process in this embodiment. In this embodiment, high-voltage conditions for charging and development and laser power are adjusted prior to halftone correction. Such density factors are set (Step 2) after the correction process is started (Step 1). The process then continues to the detection of toner patches formed on the ETB 1 for halftone correction by a controller 31.

Referring to FIG. 1, a toner patch of each color has a length of 72 mm in a process direction, including eight halftone segments with a length of 9 mm. The density of each halftone segment is determined by detecting six points at regular intervals in the vicinity of the center of the halftone segment and averaging the detection results. In this embodiment, the toner patches are formed so that they can provide the number of halftones required for grasping the γ characteristics of the apparatus and the required accuracy with which each halftone segment is detected and so that the toner patch of each color has a length that is not larger than the circumference of the drive roller 6.

One averaged sensor output is stored in the memory region for each halftone. Relatively large variations in the amount of reflected light due to the ETB 1 used in this embodiment are canceled out by a known method of calibrating (for example, normalizing) sensor outputs measured on toner patches with respect to those measured on a belt. In this embodiment, sensor outputs measured at positions on the ETB 1 where the toner patches are to be formed in the first revolution of the ETB 1 are stored and used to normalize sensor outputs measured on the toner patches formed on the ETB 1 in the second revolution of the ETB 1.

In this embodiment, a reference patch is formed on the ETB 1 to measure and store the time required for one revolution of the ETB 1, thereby aligning the detection positions of the ETB 1 and the toner patches. The time required for one revolution of the ETB 1 may also be determined using, for example, a reference mark or tape provided on the ETB 1 when the ETB 1 is formed.

If a sensor output Ps measured on the toner patches is normalized with respect to a sensor output Pb measured on the ETB 1 as described above, the normalized sensor output Ps/Pb is ideally 1.00 in the non-toner area. That is, the toner density decreases as the normalized sensor output Ps/Pb approaches 1.00 and increases as the normalized sensor output Ps/Pb approaches 0. The actual toner density is determined by converting the normalized sensor output Ps/Pb according to the properties of each color.

Figure 2:
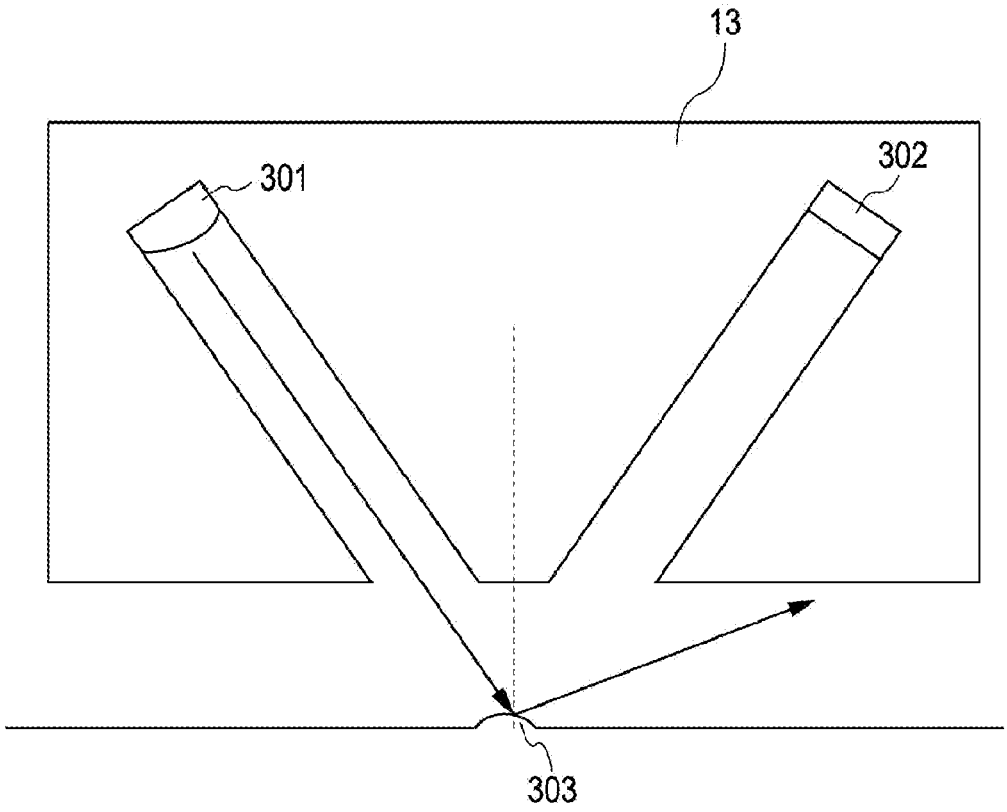
FIG. 2 is a schematic diagram illustrating the detection of a surface of a belt-like moving medium with a density sensor in the case where foreign matter adheres to a roller disposed opposite the sensor.

If foreign matter adheres to the drive roller 6, the foreign matter forms a bump on the ETB 1, and thus the light-receiving element 302 can fail to detect part of reflected light (FIG. 2). As a result, the normalized sensor output Ps/Pb deviates markedly from 1.00 even if no toner is deposited on the ETB 1. If the normalized sensor output Ps/Pb is measured to be less than 1.00, a certain toner density corresponding to the measured output Ps/Pb is improperly detected. In addition, variations in the amount of light reflected by the ETB 1 can occur despite the absence of toner and result in the misdetection of the densities of the toner patches. In the known art, foreign matter adhering to a roller disposed opposite a density sensor causes misdetection in an area where no toner is actually deposited. That is, such foreign matter causes the density sensor to improperly detect the presence of toner in the area, or causes the density sensor to improperly detect a toner density less than the actual density.

Figure 8:
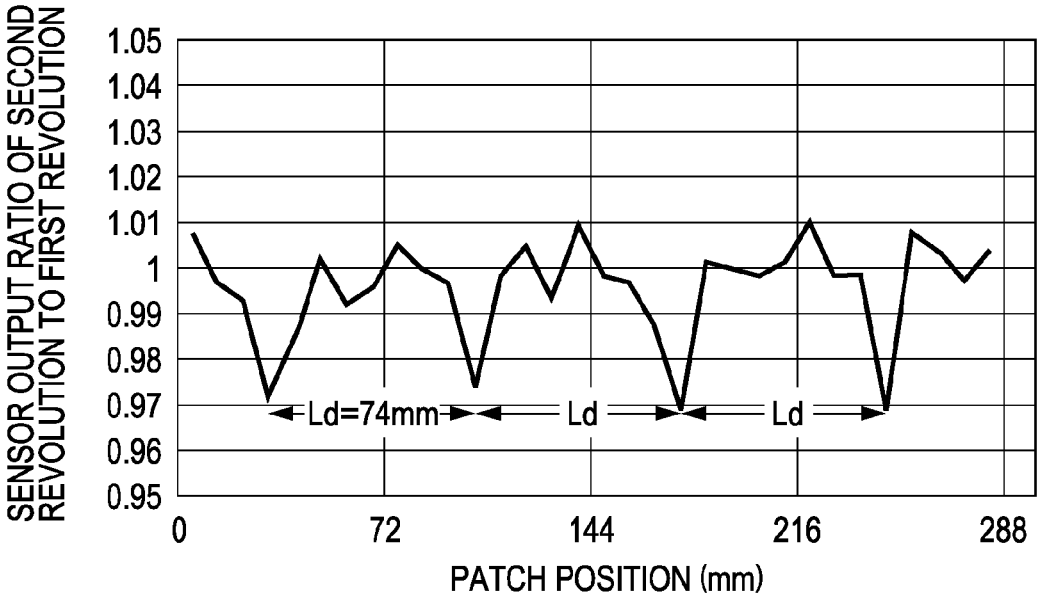
FIG. 8 is a graph showing the results of detection of the surface of the belt-like moving medium by a known method.

Misdetection due to foreign matter adhering to the drive roller 6 depends largely on the size and shape of the foreign matter and occurs at a substantially constant rate each time the drive roller 6 rotates. Hence, the measured densities of the toner patches can be corrected by measuring misdetection at each phase on the drive roller 6. FIG. 8 is an example of a graph showing the ratios of sensor outputs in the second revolution of the ETB 1 to those in the first revolution of the ETB 1 in the case where the toner patches of the individual colors have a density of zero. FIG. 8 shows that substantially regular misdetection occurs in periods corresponding to the circumference of the drive roller 6. In this embodiment, nearly ideal results can be achieved by providing a non-toner area with a length equivalent to the circumference of the drive roller 6 upstream of the toner patches in the process direction and converting data on the toner patches on the basis of data on the non-toner area.

An exemplary conversion method is described below with the measurement of yellow toner density as an example. A corrected value of a sensor output measured at the n-th halftone segment of the yellow toner patch by a known method, Y(n)', is represented by the following equation:

$$Y(n)'=Y(n)/W(n)$$

wherein Y(n) is a normalized value of the sensor output measured at the n-th halftone segment; and W(n) is a normalized value of a sensor output measured in the non-toner area at the position corresponding to the n-th halftone segment (at the same phase on the drive roller 6).

In this embodiment, W(n) is measured in the same manner as the measurement of normal toner patches; that is, the non-toner area is detected at eight positions corresponding to eight halftone segments. The measurement results are stored in the memory (Step 3). After the detection of the non-toner area is finished (Step 4), the correction process continues to the detection of the toner patches of the individual colors. Next, Y(n) is measured, corrected, and stored in the memory for each halftone segment (Steps 5 and 6).

The detection is repeated for the toner patches of the other colors. Corrected values of sensor outputs measured on the toner patches can be represented by the following equations:

$$Bk(n)'=Bk(n)/W(n)$$

$$C(n)'=C(n)/W(n)$$

$$M(n)'=M(n)/W(n)$$

After the memory stores the corrected values of the sensor outputs measured on the toner patches of all four colors (Step 7), the corrected values are converted according to the properties of each color to determine the toner densities of the toner patches (Step 8). The toner densities are then subjected to γ correction (Step 9) to complete the halftone correction process (Step 10). As described above, the corrected sensor outputs can be converted according to the properties of each color to determine toner densities with higher accuracy.

The conversion method used is not limited to the example described above, and any method that would enable practice of the present invention is applicable. For example, the conversion may be performed by compensating for the amount of misdetection by addition or subtraction. The method used for determining the density of toner deposited on the ETB 1 on the basis of sensor outputs is not limited to any particular method, and any method that would enable practice of the present invention is applicable. For example, conversion tables or conversion formulas may be used as in this embodiment.

Figure 9:
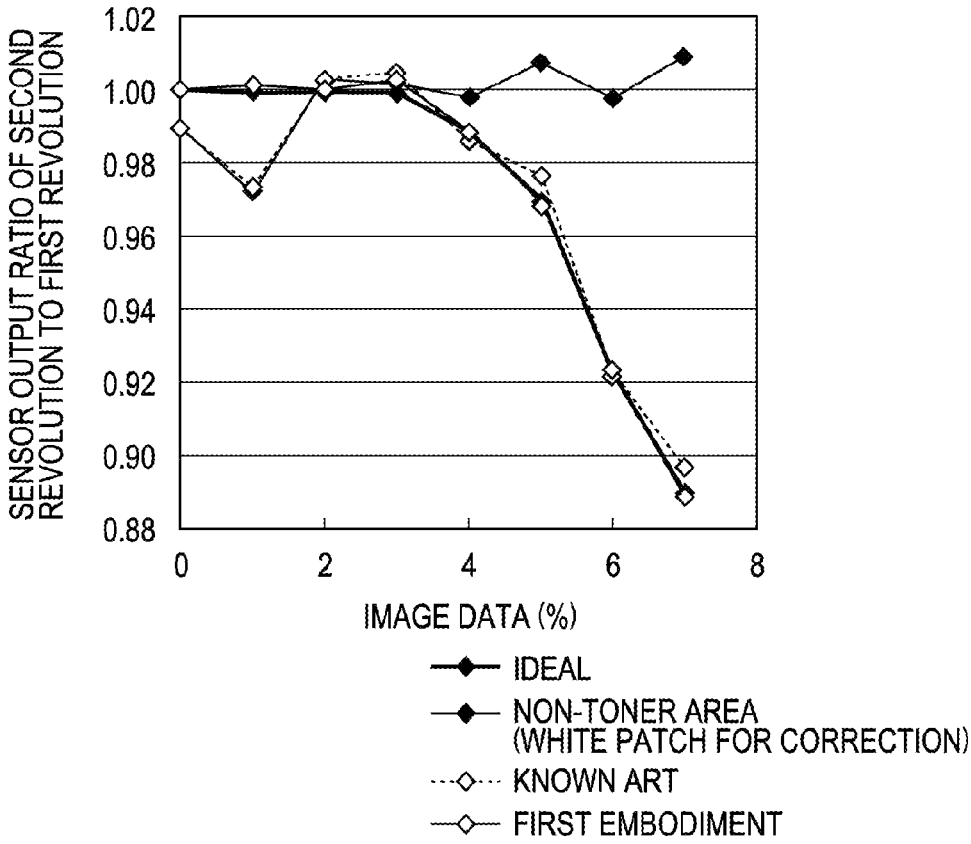
FIG. 9 is a graph showing an example of measurements of the densities of the toner patches in the first embodiment.

FIG. 9 is a graph showing the results of measurements on the densities of the toner patches by the method in this embodiment. The ideal values shown in FIG. 9 are determined by measuring the density of toner transferred to paper using a Macbeth densitometer and converting the measured density into a sensor output. FIG. 9 shows that the method used in this embodiment can cancel out variations in the amount of reflected light due to the ETB 1 and those due to the effect of, for example, foreign matter adhering to the drive roller 6. For halftone segments with lower densities, particularly, this method can suppress the maximum misdetection, not less than 10%, due to foreign matter adhering to the drive roller 6 to 4% to significantly increasing detection accuracy. In addition, the toner densities determined by the method described above may be subjected to γ correction to achieve stable images.

In this embodiment, the non-toner area with a length equivalent to the circumference of the drive roller 6 is provided together with the toner patches so that the total length thereof is not larger than the circumference of the ETB 1, thereby correcting misdetection due to the drive roller 6 more accurately. For systems including an ETB with a significantly stable circumference, misdetection due to a roller disposed opposite a density sensor can be estimated because of the stable relationship between the circumferences of the ETB and the opposite roller even if the total length of toner patches and a non-toner area is larger than the circumference of the ETB.

On the other hand, measurements on toner patches may be corrected as in this embodiment for systems including an ETB that experiences variations in circumference due to the use environment or has dimensional variations in manufacturing. The length of the non-toner area may be larger than or equal to the length of the toner patch of each color (72 mm in this embodiment). In this embodiment, the circumference of the drive roller 6 is close to the length of the toner patch of each color, and the length of the non-toner area is equal to the circumference of the drive roller 6.

The resin used for the ETB 1 in this embodiment, PVdF, has a linear expansion coefficient of about $14\times10^{-5}/°$ C., and thus can experience a change in circumference of 1 to 3 mm, depending on the use environment. As a result, the ETB 1 can cause a deviation in detection position equivalent to the change in circumference.

In this embodiment, as described above, the non-toner area with a length equivalent to the circumference of the drive roller 6 is provided together with the toner patches, and each of the distances Ld between the leading ends of the toner patches is equal to the circumference of the drive roller 6. This embodiment can thus provide a simple method for correcting the densities of the toner patches. In addition, the profile of the non-toner area does not have to be determined in detail over the length equivalent to the circumference of the drive roller 6. The memory capacity used may thus be reduced by storing only sensor outputs measured in the non-toner area at necessary roller phases.

If the ETB 1 is formed of a material that causes no variation in sensor output, such as a polyimide, the sensor outputs measured on the toner patches may be directly used to determine the densities thereof. In this case, for example, a corrected value of a sensor output measured at the n-th halftone segment of the yellow toner patch by a known method, y(n)', is represented by the following equation:

$$y(n)'=y(n)/w(n)$$

wherein y(n) is the sensor output measured at the n-th halftone segment; and w(n) is a sensor output measured in the non-toner area at the position corresponding to the n-th halftone segment (at the same phase on the drive roller 6). The use of such a material for the ETB 1 is advantageous in terms of usability because it can eliminate the need for the normalization described above to reduce the time for density control.

If the sensor outputs measured on the toner patches are normalized with respect to those measured on the ETB 1 as in this embodiment, either the measurement of the sensor outputs on the toner patches or the measurement of the sensor outputs on the ETB 1 may be performed prior to the other measurement. If a cleaning member adjacent to the ETB 1 is not provided, the measurement of the sensor outputs on the ETB 1 may be performed prior to the measurement of the sensor outputs on the toner patches to reduce the time for the Dhalf control and thus enhance usability.

The non-toner area may be positioned upstream or downstream of the toner patches in the process direction or between any two of the toner patches.

Although the image-forming apparatus including the ETB 1 has been described in this embodiment, the embodiment may also be applied to an image-forming apparatus including an ITB suspended on suspension rollers and a density sensor disposed opposite one of the rollers, as mentioned in the description of the known art.

As described above, toner density can be detected with higher accuracy by providing a non-toner area with a length that is larger than or equal to the circumference of the roller disposed opposite the density sensor 13 together with the toner patches, estimating misdetection due to foreign matter adhering to the opposite roller according to sensor outputs measured in the non-toner area, and correcting the results of measurements on the densities of the toner patches.

Second Embodiment

A second embodiment of the present invention is substantially the same as the first embodiment except that a non-toner area with a length that is at least twice the circumference of the roller disposed opposite the density sensor 13 is provided near the toner patches. The non-toner area allows the estimation of misdetection due to foreign matter adhering to the opposite roller with higher accuracy.

Figure 10:
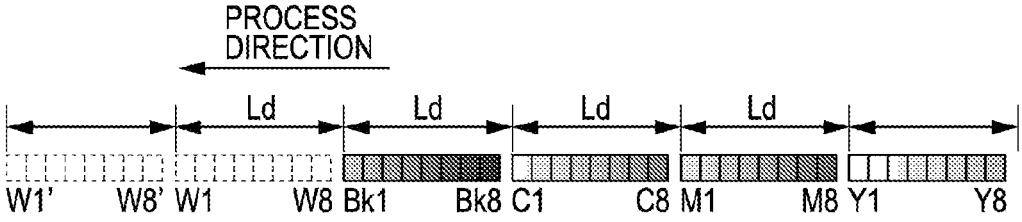
FIG. 10 is a schematic diagram of an example of toner patches used in second and third embodiments of the present invention.
Figure 11:
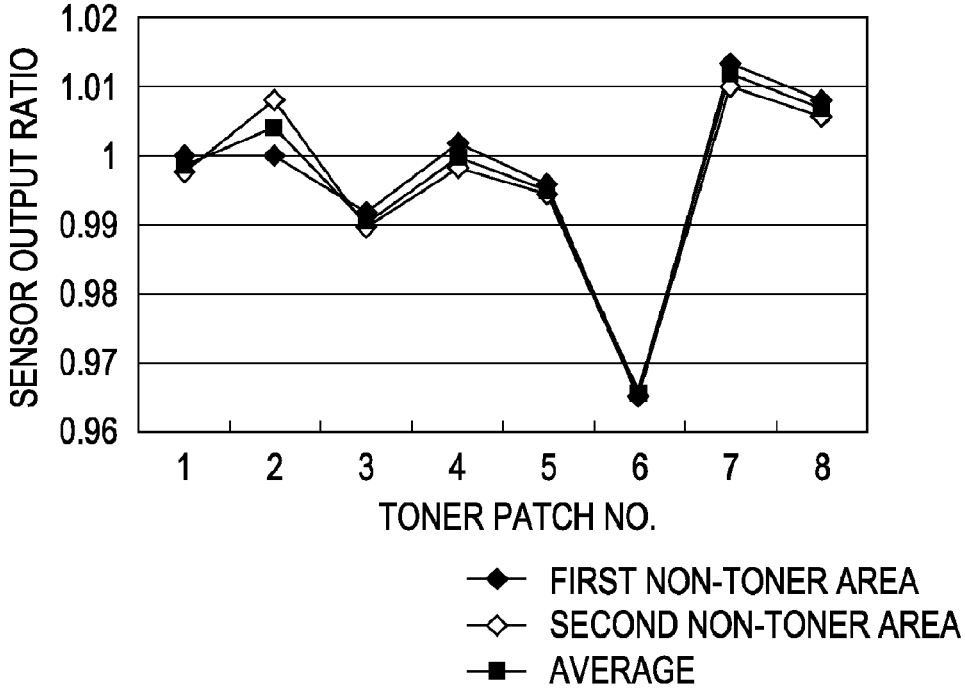
FIG. 11 is a graph showing normalized sensor outputs in the second embodiment.

Referring to FIG. 10, a non-toner area with a length that is at least twice the circumference of the opposite roller may be provided to average detection results. FIG. 11 shows that stable misdetection due to the foreign matter remains while transient factors such as variations in detection tend to diminish. The results become more reliable as the length of the non-toner area is increased relative to the circumference of the opposite roller. Alternatively, the non-toner area may be divided and separately provided upstream or downstream of the toner patches or between any two of the toner patches, as in the first embodiment.

The method according to this embodiment allows the estimation of misdetection due to foreign matter adhering to the opposite roller with higher accuracy to suppress the maximum misdetection to 3% or less.

Third Embodiment

A third embodiment of the present invention is substantially the same as the second embodiment except for the features described below. In the third embodiment, a non-toner area with a length that is at least twice the circumference of the roller disposed opposite the density sensor 13 is provided upstream of the toner patches in the process direction. The results of misdetection are stored for each revolution of the opposite roller and are compared between the revolutions of the opposite roller. The comparison results are used to correct the densities of the toner patches. The non-toner area, for example, has a length that is twice the circumference of the opposite roller (first and second non-toner areas).

If the results for the first and second non-toner areas have similar tendencies, they may be averaged and used as data for density correction, as in the second embodiment. If, on the other hand, the results have significantly different tendencies, the measured densities of the toner patches are corrected on the basis of the outputs measured in the non-toner area immediately before the toner patches.

Figure 12:
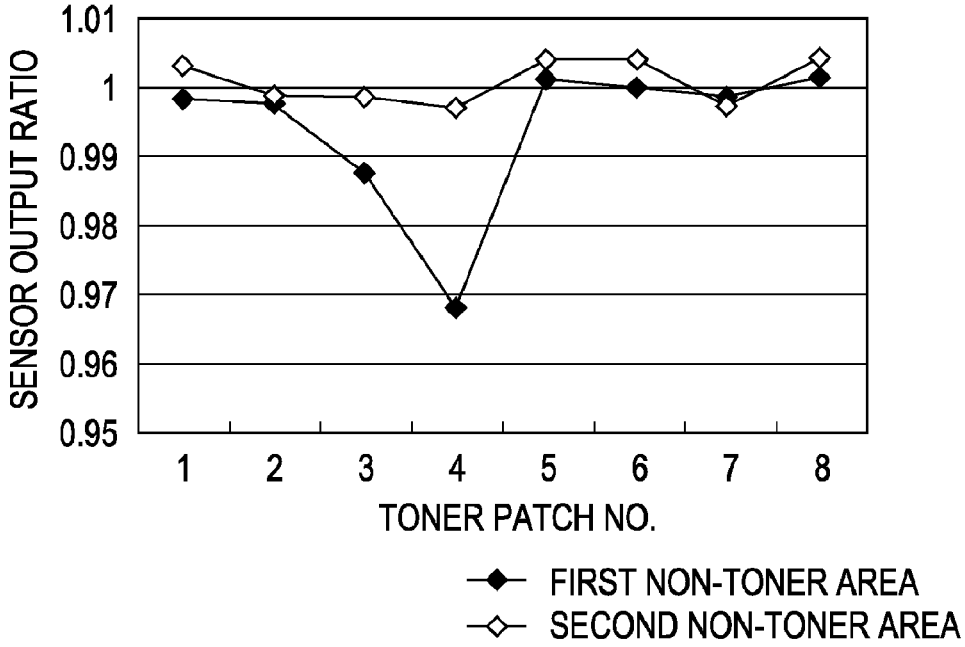
FIG. 12 is a graph showing variations in sensor output due to displacement of foreign matter on a roller disposed opposite a density sensor in the third embodiment.
Figure 13:
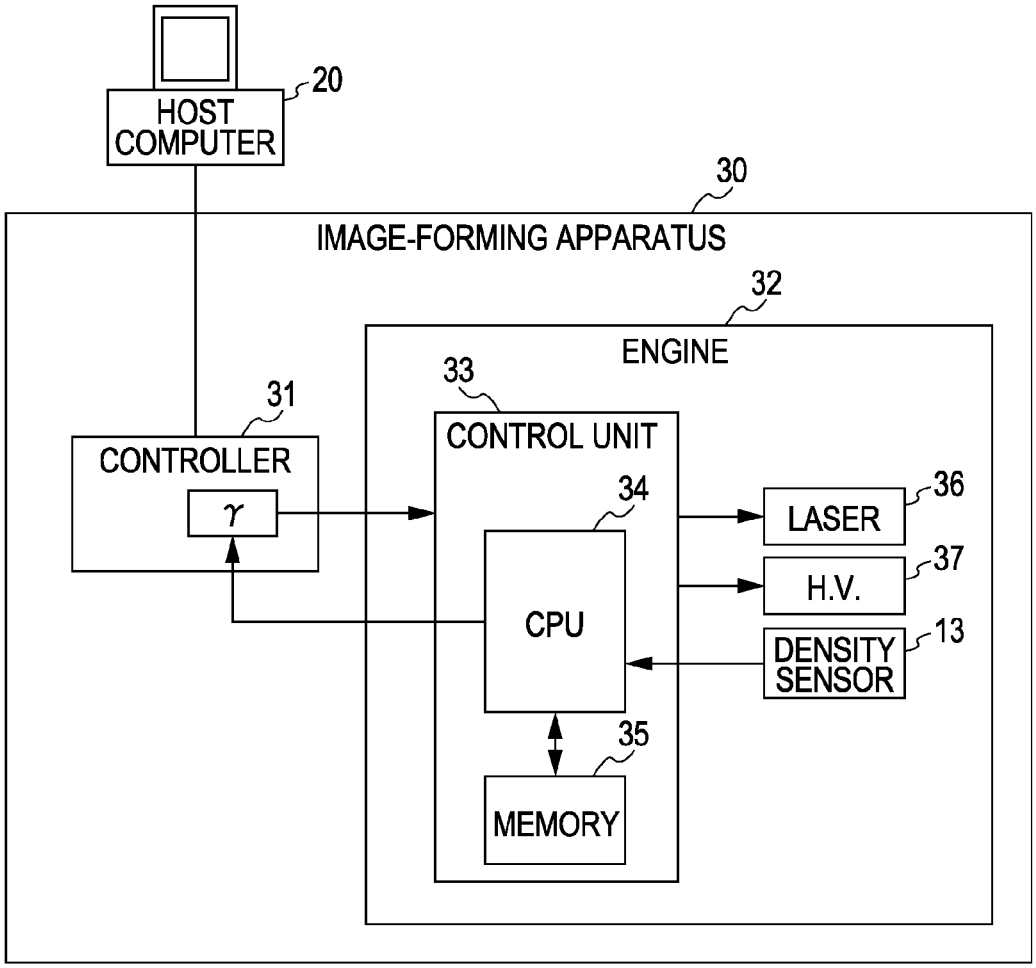
FIG. 13 is a block diagram of a control system in the present invention.

Referring to the profile graph of FIG. 12, for example, the sensor outputs measured in the first non-toner area indicate the presence of foreign matter adhering to the opposite roller while the sensor outputs measured in the second non-toner area no longer indicate the presence of the foreign matter. In that case, the state of the foreign matter adhering to the opposite roller is determined to be changed, and accordingly the densities of the toner patches are corrected on the basis of the outputs measured in the non-toner area immediately before the toner patches. This method allows accurate measurement of the densities of the toner patches despite the presence of foreign matter that does not settle at particularly positions, such as less viscous foreign matter.

In this embodiment, the data on the second non-toner area is compared with the data on the first non-toner area for each halftone segment after the normalization of the sensor outputs measured on the toner patches. If the comparison reveals a difference of 2.5% or more, the foreign matter is determined to be displaced, and thus the data on the non-toner area immediately before the toner patches is used alone for correction, rather than averaging the results for the two non-toner areas. The method used is not limited to the example described above, and any method that would enable practice of the present invention is applicable. For example, the Dhalf control may be repeated to achieve higher measurement accuracy if the data on the first and second non-toner areas has significantly different tendencies.

The correction method in this embodiment allows the determination whether foreign matter has been displaced or not. Hence, this method not only can achieve high correction accuracy as described in the previous embodiments, but also can reduce the occurrence of rare correction failures such as excessive correction and insufficient correction. The non-toner areas, which are provided upstream of the toner patches in the process direction in this embodiment, may also be provided downstream of the toner patches. In this case, the densities of the toner patches may be corrected using the data on the non-toner area immediately after the toner patches.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-226521 filed Aug. 4, 2005, which is hereby incorporated by reference herein in its entirety.

What is claimed is:

1. An image-forming apparatus comprising:

a plurality of rotatable rollers;

an endless belt suspended and moved by the rollers;

an image forming unit that forms a toner image on the endless belt, wherein the image forming unit forms a plurality of toner patch images;

an optical sensor disposed opposite a first roller of the plurality of rotatable rollers, wherein the optical sensor detects reflected light when the plurality of toner patch images are irradiated with light;

a storing unit that stores detection results detected by the optical sensor in no toner areas of the endless belt where no toner images are formed; and a correcting unit that corrects the detection results detected by the optical sensor when the plurality of toner patch images are irradiated with light based on the stored detection results of the no toner areas detected at a plurality of positions of the first roller, wherein each of the positions synchronizes with a position of the first roller, the position when the detection result of the patch to be corrected is detected, wherein a length of the no toner areas in a direction in which the endless belt is moved is approximately equal to or equal to a circumference of the first roller.

2. The image-forming apparatus according to claim 1, wherein the toner patch images comprise a plurality of patch segments formed under a plurality of conditions and are formed for each of a plurality of individual colors; and the correcting unit determines the density of each of the patch segments of the toner patch images of the plurality of individual colors.

3. The image-forming apparatus according to claim 2, wherein the total length of the toner patch images of the plurality of individual colors and the no toner areas is smaller than or equal to the circumference of the endless belt.

4. The image-forming apparatus according to claim 2, wherein each of the distances between leading ends of the toner patch images of the plurality of individual colors is equal to the circumference of the first roller.

5. The image-forming apparatus according to claim 1, wherein the optical sensor detects the endless belt with no toner image present thereon and the plurality of toner patch images formed on the endless belt before toner deposited on the endless belt is recovered.

6. The image-forming apparatus according to claim 1, wherein the positions of the first roller are specified by a phase of the first roller.

* * * * *